US008550240B2

(12) United States Patent
Marcus et al.

(10) Patent No.: US 8,550,240 B2
(45) **Date of Patent: *Oct. 8, 2013**

(54) COMBINATION WATER DOSE AND MEDICATION CONTAINER

(76) Inventors: Robert Marcus, San Diego, CA (US); Tracy Francis, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/895,352

(22) Filed: Aug. 24, 2007

(65) Prior Publication Data

US 2009/0050495 A1 Feb. 26, 2009

(51) Int. Cl.
*B65D 83/04* (2006.01)

(52) U.S. Cl.
USPC ..... 206/217; 220/4.27; 220/521; 220/524

(58) Field of Classification Search
USPC ..... 206/217, 538, 540; 220/503, 506, 520, 220/521, 524, 4.26, 4.27, 523, 527, 505, 220/525
See application file for complete search history.

(56) References Cited

U.S. PATENT DOCUMENTS

| | | | | | |
|---|---|---|---|---|---|
| 1,931,372 | A * | 10/1933 | Brown | 220/377 |
| 2,766,796 | A | 10/1956 | Tupper | 220/521 |
| 3,730,337 | A * | 5/1973 | White | 206/568 |
| 4,051,977 | A | 10/1977 | Steinfeld | 221/96 |
| 4,809,897 | A * | 3/1989 | Wright, Jr. | 224/282 |
| 5,158,209 | A * | 10/1992 | Reil et al. | 222/129 |
| 5,370,255 | A * | 12/1994 | Yang | 220/4.27 |
| 5,584,388 | A * | 12/1996 | Johnson | 206/217 |
| 6,085,930 | A * | 7/2000 | Curtis | 220/371 |
| 6,419,081 | B1 | 7/2002 | Ross | 206/217 |
| 6,488,146 | B1 * | 12/2002 | Dotsikas | 206/217 |
| 6,604,645 | B1 * | 8/2003 | Vaupotic | 220/212 |
| 2002/0121454 | A1 * | 9/2002 | Ross | 206/539 |
| 2002/0170915 | A1 * | 11/2002 | Hierzer | 220/521 |
| 2004/0262173 | A1 * | 12/2004 | Buesching et al. | 206/217 |
| 2007/0029213 | A1 * | 2/2007 | Hall | 206/217 |

* cited by examiner

*Primary Examiner* — Jocob K Ackun
(74) *Attorney, Agent, or Firm* — Bruce A. Lev

(57) ABSTRACT

A Combination Water Dose and Medication Container is disclosed. The device provides a single, pocket-sized, disposable unit that separately contains water and pills. The water chamber is foil-sealed to prevent tampering. The pill container is available pre-loaded with pills and foil-sealed, as well as empty so that the user can add his or her own pills. Five different versions of the combination container are enumerated in order to optimize flexibility to meet user tastes and manufacturing constraints.

1 Claim, 5 Drawing Sheets

COMBINATION WATER DOSE AND MEDICATION CONTAINER

BACKGROUND OF THE INVENTION

1. Field of the Invention

This invention relates generally to pill containers and, more specifically, to a Combination Water Dose and Medication Container.

2. Description of Related Art

Virtually every adult in the modern world swallows pills or some type or another on a daily basis. Pill swallowing can be an uncomfortable and even dangerous endeavor, depending upon the size of the pill and/or the quantity of pills being taken. If the pills get stuck going down, choking and/or extreme discomfort can result.

While in the home, the user has the ability to get a glass of water prior to attempting to swallow pills. If the person is away from the home, however, it is rarely so convenient. When a person leaves home knowing that he or she will need to take one or more pills during the course of the day, that individual will generally take only those pills necessary for the day, and will keep them in a small pill box, bottle or bag. Since the pills don't come with their own water source, the user must either rely on a convenient outside source, or bring along a bottle of water.

The problem is that the bottle of water is not nearly as portable as the pill container. As a result, the water bottle may be left in the car or at the individual's desk, etc. Since the pill dispenser and the water source are not associated with one another, there really isn't any insurance that the water will be there when it's time to take a pill.

What is needed, then, is a specialized container that will hold a few pills, but will also hold just enough water to wash down a swallow or two of pills.

SUMMARY OF THE INVENTION

In light of the aforementioned problems associated with the prior devices, it is an object of the present invention to provide a Combination Water Dose and Medication Container. The device should provide a single, pocket-sized, disposable unit that separately contains water and pills. The water chamber should be foil-sealed to prevent tampering. The pill container should be available either pre-loaded and sealed, or empty so that the user can add his or her own pills. A variety of styles should be available in order to optimize flexibility to meet user tastes and manufacturing constraints.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide a Combination Water Dose and Medication Container.

Figure 1:
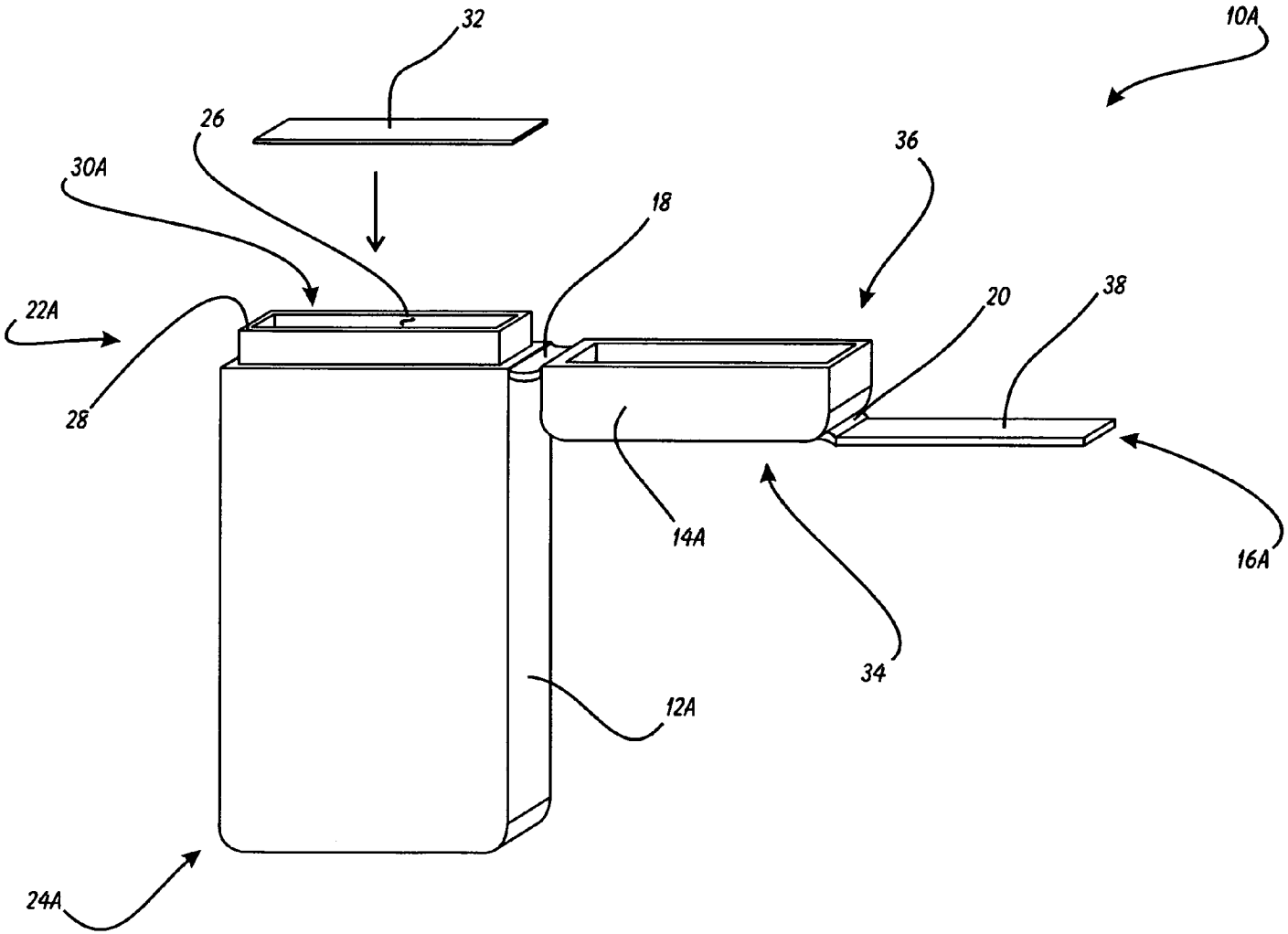
FIG. 1 is a partially exploded perspective view of a preferred embodiment of the combination water dose and medication container of the present invention.

The present invention can best be understood by initial consideration of FIG. 1. FIG. 1 is a partially exploded perspective view of a preferred embodiment of the combination water dose and medication container 10A of the present invention. The purpose of the container 10A is to provide a user with pocket-sized container for both a single dose of pills and a single dose of water sufficient to wash down the pills dose.

The container 10A has a first housing 12A for water, a second housing 14A for pills, and a lid 16A to cap off the second housing 14A. The second housing 14A is attached to the first housing 12A by a first hinge 18. The lid 16A is attached to the second housing 14A by a second hinge 20. In its preferred form, the hinges 18 and 20 are molded as part of the lid 16A and second housing 14A, such as from plastic.

The first housing 12A is defined by a first end 22A and a second end 24A. The second end 24A in this version is closed (to form the bottom of the housing 12A), while the first end 22A is defined by a first opening 26 through which the first chamber 30A is accessed. The first chamber 30A is sized to hold a swallow or two of water; the first opening 26 has a first rim 28 around its periphery. The first rim 28 provides a smooth edge to which the first membrane 32 can be adhered. The membrane 32 is preferably attached to the rim 28 via a sanitary adhesive after the first chamber 30A is filled with water (or other liquid). When the user wishes to dispense the water, he or she need simply to peel back the plastic or foil membrane 32.

The second housing 14A has a first end 34 and a second end 36. The second end 36 in this version is sealed, but may have a ridge around its periphery (as depicted here). The second end 36 is designed to cooperate with the first rim 28 and the membrane 32 to provide backup security to the sealing properties of the adhesive used to attach the membrane 32 (more below on this aspect in connection with FIG. 4.

As discussed previously, the lid 16A is hingeably attached to the second housing 14A such that it can flip over to cover the second end 34 of the second housing 14A. As should be apparent from the orientation of the elements, the top surface 38 of the lid 16A will be facing out once the lid 16A is flipped over to cover the first end 34 of the second housing 14A. If we now turn to FIG. 2, we can examine additional features of this device.

Figure 2:
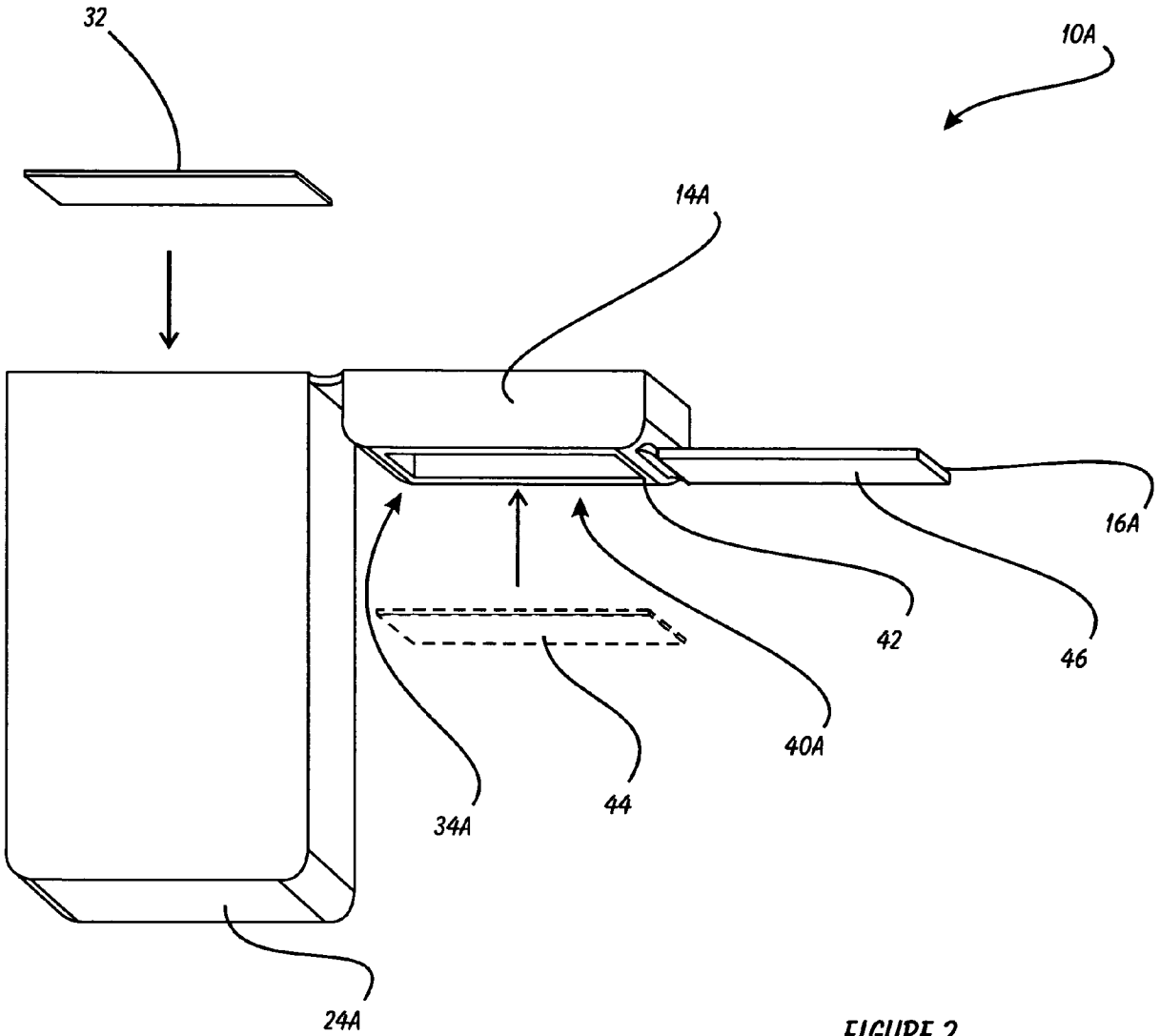
FIG. 2 is another partially exploded perspective view of the combination container of FIG. 1.

FIG. 2 is another partially exploded perspective view of the combination container 10A of FIG. 1, viewing from the bottom of the container 10A (as compared to the orientation of the device in FIG. 1). The sealed second end 24A of the first housing 12A can be seen in this view to be a generally flat surface; in other versions, a more ergonomically-shaped (e.g. rounded) surface may be provided.

The second housing 14A has a second chamber 40A formed therein. This chamber 40A is provided to give the user a small storage compartment for a single dose of pills. The chamber 40A is accessed through the opening formed in the first end 34A of the second housing 14A. The second rim 42 forms the periphery of the opening to the second chamber 40A.

A second membrane 44 is depicted here in hidden lines in order to indicate that the membrane 44 may or may not be included with all containers 10A, depending upon the particular use that the container 10A is being put to. For example, if the user has obtained a set of containers 10A with the intent of self-loading them with each pill dosage (e.g. vitamins or other daily pill regimen), then the second membrane 44 would not be included with the container 10A. The container 10A would come with the first chamber (see FIG. 1) pre-filled with water and sealed with the first membrane 32. The second chamber 40A, however, would simply be covered by the lid 16A, so that the user can flip open the lid 16A to load the pills.

Alternatively, if the user obtains his or her set of containers 10A pre-loaded with pills in the second chamber 40A, then the second chamber 40A would be sealed by a second membrane 44 adhered to the second rim 42. This would be the case, for example, if the container 10A is used in connection with prescription drugs. In fact, in that scenario, the pharmacy (or other dispensary) could pre-load the containers 10A (i.e. their second chambers 40A) with a mix of pills that the user is to take as a group as a single dose. This would make it much more convenient for the user, and the user wouldn't have to either create his or her own package of daily dosages each day, nor would he or she have to carry all of the individual pill bottles around all day long. In these situations, the foil or plastic membrane 44 would be provided to seal the pre-made dosages within the second chamber 40A. We will now turn to FIGS. 3 and 4 to take a final look at this version of the device of the present invention.

Figure 3:
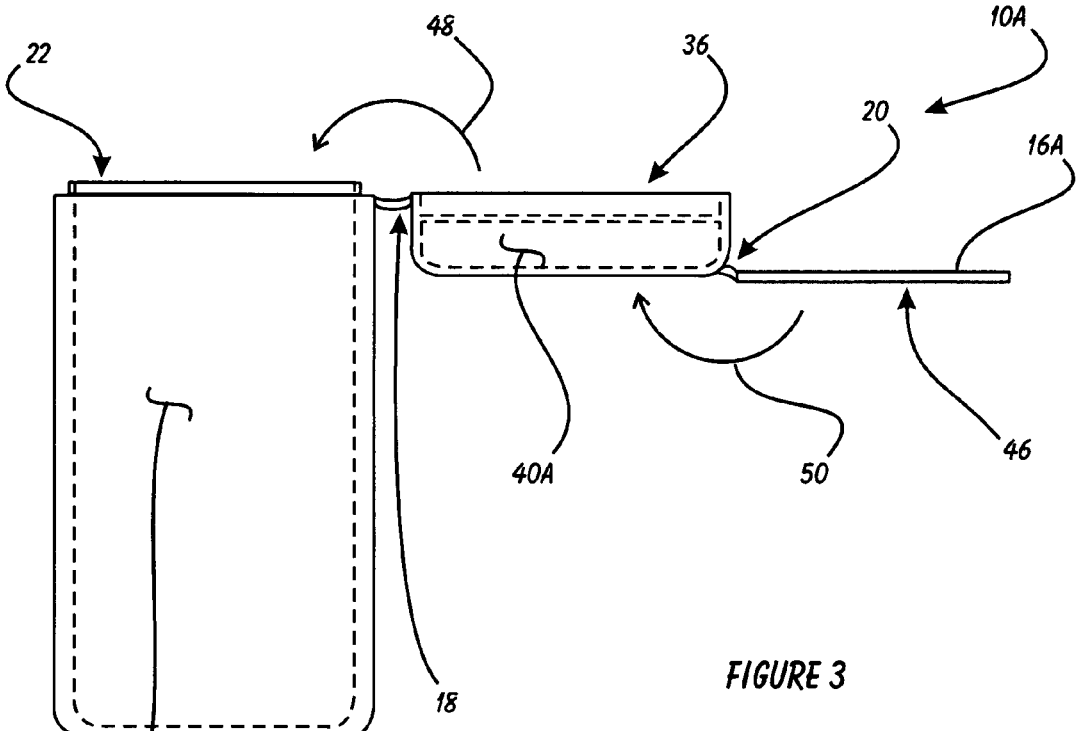
FIG. 3 is a side view of the combination container of FIGS. 1 and 2.
Figure 4:
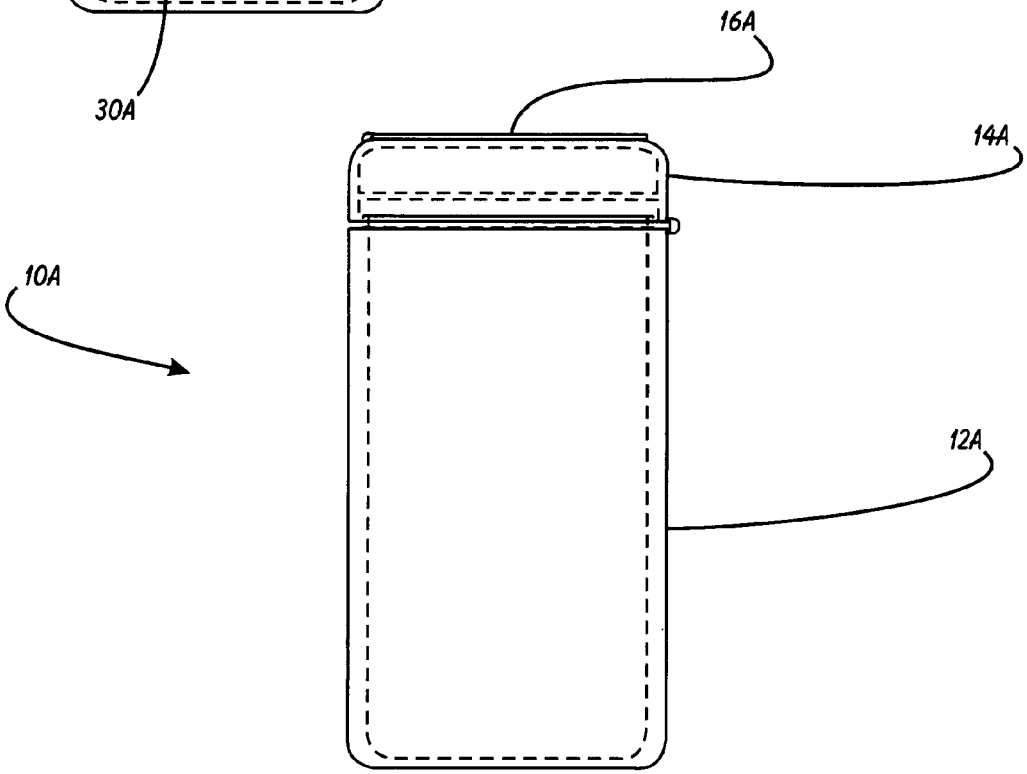
FIG. 4 is a side view of the combination container of FIGS. 1-3.

FIG. 3 is a side view of the combination container 10A of FIGS. 1 and 2 and FIG. 4 is a side view of the combination container 10A of FIGS. 1-3. Essentially, FIG. 3 is a view of the device 10A with both chambers open, and FIG. 4 is a view of the same device 10A after the chambers have been closed. The second end 36 of the second chamber 40A will cover over the first end 22 of the first chamber 30A if the second housing 14A is rotated about the first hinge 18 in the direction of arrow 48. The bottom surface 46 of the lid 16A will cover the second chamber 40A if the lid 16A is rotated about the second hinge 20 in the direction of arrow 50.

Once the second housing 14A is folded over and the lid 16A is folded over, the device 10A will present the compact, sleek, pocket-sized profile shown in FIG. 4. This package can be easily carried by the user in their pocket or purse, among other places.

While the previously-described product version has some very desirable features, the inventors have gone on to develop other embodiments that are somewhat modified versions of this first container. The first of these modified versions is depicted in FIG. 5.

Figure 5:
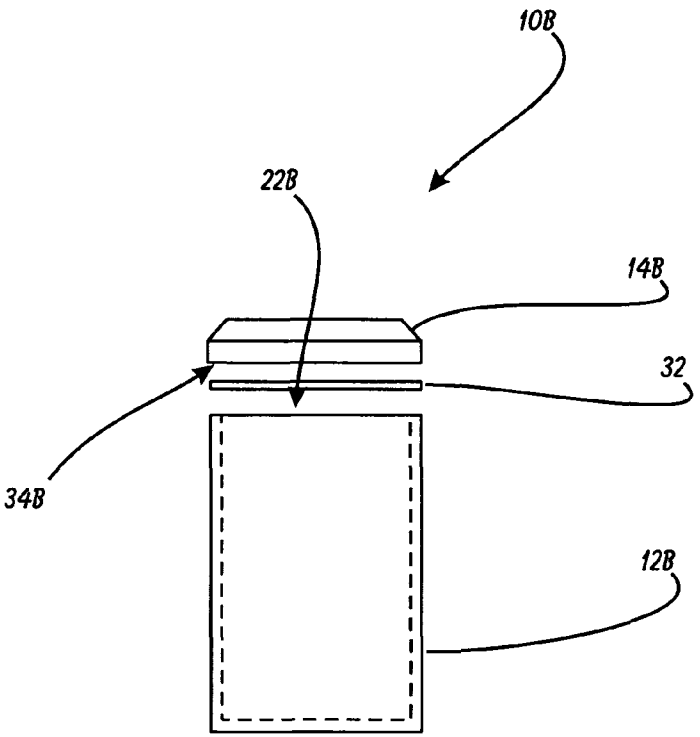
FIG. 5 is a side view of a second preferred embodiment of the combination water dose and medication container of the present invention.

FIG. 5 is a side view of a second preferred embodiment of the combination water dose and medication container 10B of the present invention. In this version, the second housing 14B is not hingeably attached to the first housing 12B, but rather simply snaps onto the first end 22B of the housing. Like the version discussed above, the first end 22B of the first housing 12B is sealed with a membrane 32, since the liquid is contained therein. Unlike the first embodiment of the device, the first end 34B of the second housing 14B is oriented towards the first end 22B of the first housing 12B. The open end of the second housing 14B is still at the first end 34B, but it is directed down, rather than up. Of course the top end (as shown here) of the second housing is a solid wall.

Figure 6:
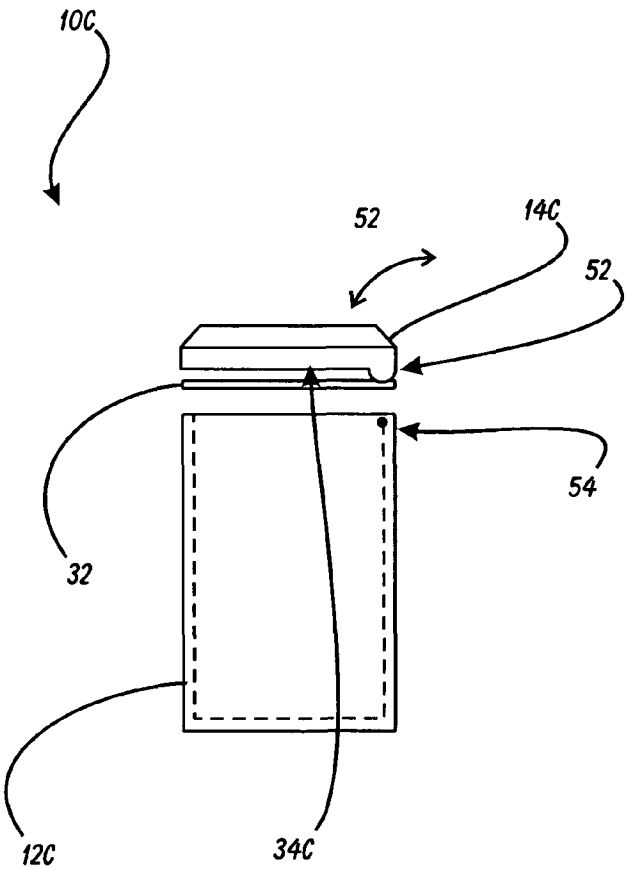
FIG. 6 is a side view of a third preferred embodiment of the combination water dose and medication container of the present invention.

In order to load or dispense pills, the user need simply pop off the second housing 14B to expose the first end 34B. Load the desired pills into (or remove them from) the second chamber. If loading, simply flip the device 10B upside down and snap the two housings back together. If dispensing the pills, simply drop them out of the second chamber, pull off the membrane 32, take the pills and swallow the liquid contained within the first chamber. FIG. 6 depicts a slightly modified version of this design.

FIG. 6 is a side view of a third preferred embodiment of the combination water dose and medication container 10C of the present invention. Similar to the previous design, this container 10C has its second housing 14C attached to the top of the first housing 12C with the first end 34C facing down. The membrane 32 is sealed to the open end of the first housing 12C.

What is different here is that the second housing 14C is hinged to the first housing 12C. Rather than providing the hinge as in the device of FIGS. 1-4, here, the hinge action is provided by a pair of arms 52, one on each side of the second housing 14C. Each arm 52 has an inwardly-turned hinge finger that engages a bore or dimple 54 on opposite sides of the first housing 12C. The second housing 14C can rotate around the hinge in the direction of indicator arrow 52. Yet another modification to this basic design is depicted in FIG. 7.

Figure 7:
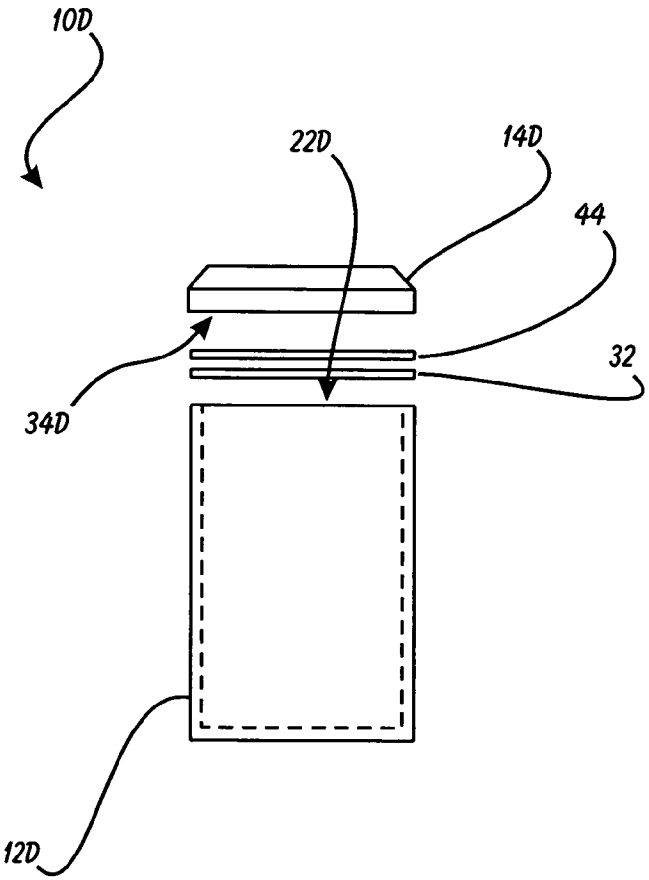
FIG. 7 is a side view of a fourth preferred embodiment of the combination water dose and medication container of the present invention.

FIG. 7 is a side view of a fourth preferred embodiment of the combination water dose and medication container 10D of the present invention. This container 10D is essentially the same design as provided above in FIG. 5, with one exception. There is a second membrane 44 adhered to the first end 34D of the second housing 14D. As discussed above in connection with FIGS. 1-4, this second membrane 44 provides for the safety, hygiene and security of pre-loaded pills within the second housing's chamber. Of course, the design of FIG. 6 could similarly be modified to add the second membrane, just as was executed here. Finally, turning to FIG. 8, we can examine yet another version of the device.

Figure 8:
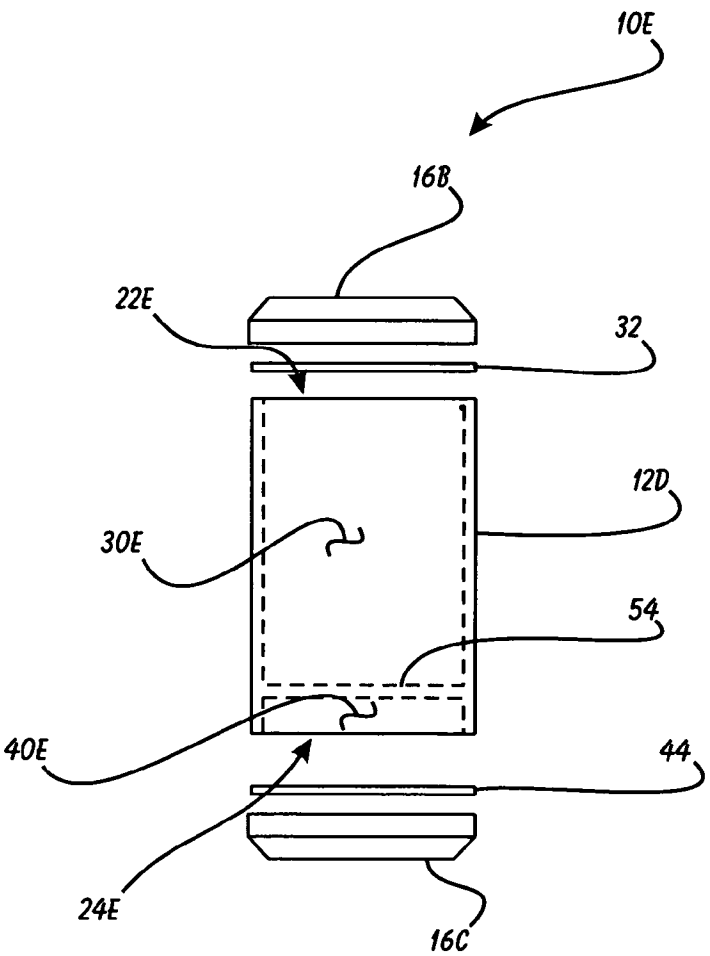
FIG. 8 is a side view of a fifth preferred embodiment of the combination water dose and medication container of the present invention.

FIG. 8 is a side view of a fifth preferred embodiment of the combination water dose and medication container 10E of the present invention. Here, the first housing 12D contains both the first chamber 30E and the second chamber 40E; the chambers form the interior of the housing and are separated by an internal wall 54. The first chamber 30E opening is on the first end 22E of the first housing 12D. The second chamber 40E opening is located at the second end 24E of the first housing 12D. Each chamber (here) is sealed with its own membrane (32, 44), but certainly the second membrane 44 could be eliminated.

To simplify the design of this container version 10E, there are first and second lids 16B, 16C that snap on to the first and second ends 22E, 24E, respectively, to either close off the related chamber (i.e. the second chamber 40E), or to protect the membranes 32, 44 from being accidentally punctured.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A multiple container assembly sized to fit within a conventional pocket or purse, comprising:

a first housing defined by two pairs of generally parallel walls, said first housing forming a first chamber defining a liquid volume of between 12.9 and 34.1 milliliters having a first housing top opening, said first housing top opening being the sole opening into said first chamber;

a membrane attached over said first housing top opening;

a second housing defined by two pairs of generally parallel walls, said second housing forming a second chamber having a bottom side and a top side defined by a top opening formed therein, said top opening being the sole opening into said second chamber;

a membrane attached over said second housing top opening;

a hinge element interconnecting said second housing to said first housing, said hinge element attached adjacent to said top opening of said first housing and said bottom side of said second housing;

wherein said housings are cooperatively designed such that said second housing is positionable into a juxtaposed position over said first housing, whereby said bottom side of said second housing is facing said top opening of said first housing;

and wherein said second housing is defined by a lip around said bottom side, wherein said lip is detachably attachable to said first housing whereafter said top opening of said first housing is encircled by said lip.

* * * * *